US007322267B1

(12) United States Patent
Munson, Jr.

(10) Patent No.: US 7,322,267 B1
(45) Date of Patent: Jan. 29, 2008

(54) ENHANCED LIGHT WEIGHT ARMOR SYSTEM WITH REACTIVE PROPERTIES

(75) Inventor: David Murray Munson, Jr., Dallas, TX (US)

(73) Assignee: FOI Group, LLC, Dallas, TX (US)

( * ) Notice: Subject to any disclaimer, the term of this patent is extended or adjusted under 35 U.S.C. 154(b) by 25 days.

(21) Appl. No.: 11/153,161

(22) Filed: Jun. 15, 2005

Related U.S. Application Data

(60) Provisional application No. 60/579,882, filed on Jun. 15, 2004.

(51) Int. Cl.
*F41H 5/007* (2006.01)

(52) U.S. Cl. ..... 89/36.02; 89/36.01

(58) Field of Classification Search ..... 89/36.17, 89/36.02; 428/116, 117, 911, 118, 305.5
See application file for complete search history.

(56) References Cited

U.S. PATENT DOCUMENTS 2,376,331 A * 5/1945 Abrams ..... 89/36.08
3,916,060 A * 10/1975 Fish et al. ..... 428/299.4
4,364,300 A 12/1982 Pagano et al.
4,426,429 A 1/1984 Di Russo et al.
4,613,535 A * 9/1986 Harpell et al. ..... 428/113
4,732,803 A 3/1988 Smith, Jr.
4,836,084 A 6/1989 Vogelesang et al.
4,883,700 A 11/1989 Harpell et al.
4,979,425 A 12/1990 Sprague
4,981,067 A * 1/1991 Kingery ..... 89/36.17
5,149,910 A 9/1992 McKee
5,167,876 A 12/1992 Lem et al.
5,293,806 A 3/1994 Gonzalez
5,349,893 A * 9/1994 Dunn ..... 89/36.05
5,587,230 A 12/1996 Lin et al.
5,686,689 A 11/1997 Snedeker et al.
5,788,110 A * 8/1998 Alhamad ..... 342/4
5,830,548 A * 11/1998 Andersen et al. ..... 428/36.4
6,004,424 A 12/1999 Cordova et al.
6,021,703 A * 2/2000 Geiss et al. ..... 89/36.17
6,216,579 B1 4/2001 Boos et al.
6,276,254 B1 8/2001 Cordova et al.
6,357,332 B1 3/2002 Vecchio
6,387,200 B1 * 5/2002 Ashmead et al. ..... 156/79
6,622,608 B1 9/2003 Faud et al.
6,847,699 B2 * 1/2005 Rigali et al. ..... 378/143
6,880,445 B2 * 4/2005 Benyami et al. ..... 89/36.17
6,892,623 B2 * 5/2005 Benyami et al. ..... 89/36.02
6,945,155 B2 9/2005 Cordova et al.

(Continued)

*Primary Examiner*—Michael J. Carone
*Assistant Examiner*—Stewart T Knox
(74) *Attorney, Agent, or Firm*—Hemingway & Hansen, LLP; D. Scott Hemingway

(57) ABSTRACT

A light-weight armor system for retrofitting onto light vehicles, such as HMMWVs, trucks, or helicopters, or incorporating into a vehicle to protect against HEAT or high explosive warheads. The armor system comprises multiple layers of a thin metal film. The front side of the thin metal sheet facing away from the vehicle is coated with a layer of zirconium nanoparticles and imprinted with a network of hollow packets filled with water and sealed. The back side of the thin metal sheet is coated with a layer of potassium bicarbonate powder. The multiple layers of metal film are imbedded in a matrix of composite foam to form a honeycomb structure that can be retrofitted onto light vehicles or used in new designs.

11 Claims, 3 Drawing Sheets

U.S. PATENT DOCUMENTS

2001/0012812 A1* 8/2001 Spengler ..... 493/100
2001/0032541 A1* 10/2001 Benyami et al. ..... 89/36.02
2003/0161750 A1* 8/2003 Moxson et al. ..... 419/2
2004/0002559 A1* 1/2004 Troutman et al. ..... 524/100

* cited by examiner

ENHANCED LIGHT WEIGHT ARMOR SYSTEM WITH REACTIVE PROPERTIES

RELATED APPLICATION DATA

This application is related to Provisional Patent Application Ser. No. 60/579,882 filed on Jun. 15, 2004, and priority is claimed for this earlier filing under 35 U.S.C. § 120. The Provisional patent application is also incorporated by reference into this utility patent application.

TECHNICAL FIELD OF THE INVENTION

A light weight armor system for protecting general purpose, support military vehicles.

BACKGROUND OF THE INVENTION

All combat combines both defense and offense. However the traditional battlefield has almost always had a safe rear area to provide for the fighting forces. Current weaponry and support vehicles have been designed following this age old pattern: The fighting equipment and men defend the support equipment and men. Armored vehicle technology has been exclusively the domain of the Armored Fighting Vehicle. Armored fighting vehicles (AFVs), both tanks and armored personnel carriers (APCs), first saw limited use in World War I. These early AFVs were little more than crude armor boxes built on caterpillar-tracked tractors. Both armor and weaponry have escalated dramatically since then.

In the early 1930s, shaped-charged warheads were developed that offered vastly superior armor penetrating performance coupled with ease of use and employment. The basic principle of the shaped-charge warhead is a concave or cone shaped hollow area in one end of the explosive core of the warhead. This hollow area is lined with a metal, typically copper. Upon detonation, the metal liner is compressed into a jet of very dense, superplastic metal moving at a speed of approximately 30,000 feet per second. While the actual material properties and physical behaviors are still not very well understood, the hypervelocity jet of metal can punch a hole in steel plate armor many times thicker than the diameter of the shaped-charge warhead.

Detonation distance is critical because the jet disintegrates and disperses after a relatively short distance (no more than 2 meters typically). The critical factor to the effectiveness of a HEAT round is the diameter of the warhead. As the jet penetrates the armor, the width of the hole decreases leading to a characteristic "fist to finger" penetration effect. That is, the size of the eventual "finger" penetrating into the AFV depends on the size of the original "fist". In general, a HEAT round will penetrate armor thickness 150% to 250% of their diameter, although modern versions, such as the latest Russian RPG-7V, claim penetration ratios as high as 700% of the warhead diameter.

By the end of World War II, various anti-tank weapons had been developed and deployed that could be carried by one man to defeat AFVs, including hand-thrown grenades (e.g. Russian RPG-43) and warheads mounted on a rocket and launched from a rocket launcher (e.g. United States M7A1—"Bazooka"). Since World War II, HEAT rounds have become almost universal as the primary anti-vehicle weapon, because it can be used against all AFV and unarmored targets such as trucks and other general purpose vehicles or bunkers.

In modern warfare, man-portable anti-tank weapons represent one of the greatest threats on the battlefield. These weapons are relatively light, easy to transport, and can defeat most AFV armor if the AFV is struck in a vulnerable location. The Soviet RPG-7 is probably the most ubiquitous of these weapons, because it has been produced by most Soviet client states including all of the former Warsaw Pact countries, Egypt, Libya, Iraq, Iran, China, North Korea, and numerous other countries, and it has been widely disseminated by these numerous producing countries. The RPG-7's maximum effective range against moving targets is 300 meters and the maximum range is 920 meters, and it can penetrate up to 600 millimeters (23 inches) of rolled homogeneous steel armor.

In the technology race of anti-tank weaponry versus armor protection, AFV armor protection technology has attempted to match increased lethality. Armor protection has improved dramatically and increasing use has been made of more unconventional means to increase protection. One of the unconventional modifications used in unconventional combat has been the use of standoff screens around a fighting vehicle to prevent shaped charges from detonating against the vehicle armor. Sand bags have also served as additional armor as have water cans. While many of these armor advances have been proven effective and have been deployed on heavy AFVs, there has been virtually no effort to protect lighter non-combat vehicles such as trucks and the M998 HMMWV family of vehicles. While the M998 series has been modified with additional armor to increase protection against large caliber bullets and land mines, there has been little progress at protecting these rear echelon support vehicles from light anti-tank HEAT warheads, since it was believed that they were going to be protected by the fighting vehicles in the historic battlefield configuration.

Similar concerns apply to military aircraft. With dawn of the transistor age and silicon chip technology coupled with advances in solid-fuel rocket booster technology, man portable air defense systems (MANPADS) based on small, light-weight surface-to-air missiles (SAMS) have proliferated greatly over the years.

The United States pioneered the development of MANPADS with the introduction of the RIM-43 Redeye SAM in 1966. The Redeye was developed in the 1950s and is a heat-seeking missile that senses the exhaust heat from the engines and directs the missile toward that heat source. Modern MANPADS predominately are small, shoulder-fired, infrared seeking SAMs that home in on the infrared energy emissions of the target aircraft. They are effective against jet, propeller, or rotor (e.g. helicopter) aircraft. There are an estimated 500,000 MANPADS in existence.

Currently, the following are the most prevalent MANPADS:

1) Strela-2 (SA-7a): Soviet designed IR guided SAM that can engage aircraft flying above 50 meters and below 1500 meters. The warhead detonates upon impact with the target.

2) Strela-2M (SA-7b): Improved guidance over the earlier Strela-2 allows the missile to engage transport and rotor aircraft head-on as long as the target speed is less than 540 km/hour. The missile target ceiling is 2300 meters and can engage targets out to 4.2 km.

3) Strela-3 (SA-14): The SA-14 entered service in 1974. Possesses an improved IR seeker allowing engaging jet aircraft head-on and reducing effectiveness of flare countermeasures. Can effectively engage target within an altitude limitation of 30 meter to 3000 meters.

4) Igla-1 (SA-16) and Igla-2 (SA-18): Soviet SAM equipped with both a proximity and an impact fuse. Maximum range of 5.2 km and can engage targets in the altitude range between 10 meters and 3500 meters.

5) FIM-92 (Stinger): US manufactured SAM having a range of 4.8 km. Has a maximum speed of Mach 2.2.

Other MANPADS include the Swedish Bofors RBS-70, the British Shorts Blowpipe and Javelin.

All of these SAMs are somewhat hampered by the small high explosive warhead, which is designed to explosively project shrapnel into a target aircraft. However, the small warhead can cause significant damage to any aircraft and is effective against both civilian and military aircraft, and the small missiles are of primary concern for military helicopters operating against guerrilla insurgencies or terrorist organizations. At least 27 guerrilla or terrorist organizations are believed to possess these weapons.

The current situation faced by United States military forces in Iraq and Afghanistan, as well as likely military deployments in the future, has underscored the reality that rear echelon, support forces and their attendant vehicles are more likely, because of this vulnerability, to come under fire from light anti-tank weapons. Various irregular combatants are increasingly attacking support and rear echelon areas and bringing light vehicles under fire with RPGs and improvised munitions, such as artillery shells rigged as command-detonated mines. There is also an increasing threat to low-flying helicopters or jet aircraft engaging ground targets or landing at airfields, where they are flying within the altitude engagement zone, from attacks from most MANPADS. There is a need for a robust, light armor system that can be retrofitted on existing vehicles and aircraft or be incorporated into new designs to provide effective HEAT or MANPADS SAM warhead protection without a prohibitive weight penalty.

SUMMARY OF THE INVENTION

The invention is a lightweight armor system that prevents penetration of the passenger or cargo compartment of both unarmed and armed vehicles by the jet from a HEAT warhead found on light anti-tank weapons such as the RPG-7, as well as improvised explosive devices, and some kinetic energy weapons. The invention also provides protection to aircraft from the small high explosive warhead of MANPADS. The invention is contemplated as an add-on, modular system that may be retrofitted on existing vehicles and aircraft, incorporated as part of the structure of the next generation vehicles and aircraft, or mounted on buildings using backpanel 2.

The underlying concept is to divert, dissipate, and cause premature particulation to occur to the jet stream of a HEAT warhead, rather than attempting to stop it, and dissipating the kinetic energy from a high-explosive, fragmenting warhead of a MANPADS. No lightweight armor structure can protect using the same techniques as the heavy armored vehicles. Just as a man with a bamboo stick can deflect a sword if he hits it on the side, so can a lightweight flexible structure deflect the jet stream or warhead fragments with forces perpendicular to the travel trajectory.

Shaped-charge jet streams are thin long irregular collections of metal and gas. Particulation, or the breakup of the stream into discrete particles, causes the velocity to drop very quickly as the surface area and frontal area goes up. This invention accelerates the breakup of the jet stream by several methods. The initial and subsequent layers of the armor will both push and pull on the jet stream or on fragments perpendicular to the direction of travel for deflection. During this process the jet stream or fragments impacts a variety of substances designed to absorb heat and kinetic energy while imparting additional lateral loads on the jet stream or fragments. The interior of the armor system is filled with additional deflecting panels to deflect toward either the ground or the air depending on the starting point of the round. One significant feature of this armor system is a reduction in shrapnel and concussion both inside the vehicle and to bystanders.

There are four or more component layers of the armor system. The component layers consist of an outer waterproof flexible coating, a formed light outer structural layer, one or more multi-component thermal and kinetic energy absorbing layers, and an inner hard composite ballistic barrier and structural support. The first component layer is a formed light section of thin metallic ductile film or films formed into a honeycomb like configuration by folding and deformation. Additionally, tiny shaped pockets are formed in the film with the openings facing outwards such that the pockets completely cover the surfaces likely to be exposed to the shaped charge jet stream.

The outer layer of the formed film, including the pocket surfaces, is coated with hard metallic nanoparticles. The outer layer openings in the honeycomb should be sized to allow a RPG rocket or MANPADS to become wedged in place and have sufficient depth to prevent fuse detonation from occurring in many instances. Because of the intended design characteristics of elastic and plastic deformation, a warhead can be thrown away from the target or can cause the warhead to rotate to a desired angle relative to the vehicle regardless of its initial direction. This ensures that if it detonates, the jet stream's or fragments initial direction is partially angled away from the protected areas. To accomplish this, areas that need higher strength to rotate the warhead can have additional layers of higher strength material, whereas areas that need to deform to allow rotation can be composed of thinner and weaker films.

The outer covering or coating seals the small pockets after they are filled with a water-antifreeze mixture. The miniature pockets allow very high rates of heat transfer to the water not only cooling the film for an instant but also creating a high pressure steam pocket at the point of contact to reactively blowback into the metal jet to disrupt, further cool, disperse, and assist in diverting the jet stream away from the crew compartment.

Because the angle of attack to the initial surface is designed to be nearly parallel, the jet or fragments will likely slide on the hard nanoparticles covering the deflecting surface to the bottom edge of the first cell and/or water pockets. The bottom, or innermost section, of the defecting surface would have an extra few molecules of thickness of metallic nanoparticles and can be coated with high temperature, low friction materials such as Teflon. It will also be reinforced with fibers and a matrix containing potassium bicarbonate (more commonly referred to as Purple K) and structural components to allow it to deflect the metal jet at an additional angle. Larger or layered water capsules may also be incorporated to cool and push against the jet stream.

The side opposite the deflecting surface of the section is intended to assist deflection by inducing friction forces on the opposite side of the jet stream using sticky plastic films or strands coated with Purple K and carbon fibers. These would be designed to yield on the deflecting side so as either catch on the jet stream's front and side or to drag along the side of the jet stream rather than being penetrated, thus creating more drag force. The outer strands will be stronger and contain more Purple K to create more turning force and cooling initially than some of the inner fibers. These strands can also be woven into nets of carbon fiber with plastic attachments line that elongate at a relatively constant tension. This will slow the jet stream and create an imbalance of mass distribution. It will also begin to cool and slow the hot gases surrounding the metal stream on the desired side. Reducing the gas pressure on one side creates additional force deflecting the jet stream and fragments.

The second layer of the structure is a mixture of specially designed microspheres, an agent such as Purple K, binding agents and structural fibers and thin metallic films which lines and supports the inner facing side of the formed metallic film. These sections serve to additionally divert, cool and cause early particulation to occur.

Additional inner components are separated by sections filled with very light weight materials. An inflammable gas filled plastic bubble film can be included that would be fairly viscous for the metal jet to travel through. This creates a frictional force pulling the jet stream or fragments away from the deflecting surfaces. Thus, the stream or fragments are both pulled and pushed away from its initial path into the vehicle or aircraft. Because of the likelihood that a jet stream or fragments will penetrate a given layer, all materials in the middle section will be designed to help divert a jet stream or fragments even if it not in a designed path. To assist in this diversion the inner components would be designed to selectively fail so as to create a path of least resistance away from the protected areas, and direct the fragments or jet stream along that path.

Ideally the gas bubbles would be overpressured with an inert gas and saturated with water vapor. The film could be coated with adhesive and a coating of Purple K to further absorb heat and reduce heat transfer to the target vehicle. Additionally carbon or other fibers can be incorporated into the films to increase their tensile strength as needed. While aluminum would seem an undesirable material for traditional armor components, it has very good characteristics for parts of this system. These include very high heat of fusion, high heat transfer, elasticity, and reasonable cost. The innermost layer would be a conventional type composite panel which would provide ballistic protection from fragments, and small arms fire as well as structural support for the outer layer. This layer would serve as the vehicle wall on new vehicles or on retrofits serve as the attaching surface to an existing body. It can be shaped as needed to meet design requirements.

This armor system can be designed as either a fixed shape system or incorporate means of inflating and deflating sections of the armor to narrow vehicle sections for transport or other needs. The system is envisioned to be constructed of overlapping outer sections that can be field replaced to keep a vehicle in service.

BRIEF DESCRIPTION OF THE DRAWINGS

The objects and features of the invention will become more readily understood from the following detailed description and appended claims when read in conjunction with the accompanying drawings in which like numerals represent like elements and in which:

DETAILED DESCRIPTION OF THE PREFERRED EMBODIMENTS

One of the limitations of lightweight armor is that by its very nature it has a low capacity to absorb and dissipate large amounts of heat and kinetic energy. Shaped-charge and high-explosive fragmenting weapons produce both high heat and high kinetic energy. As the charge or fragments slide along or penetrate the armor along the path 3 some of the kinetic energy is converted into heat, melting or vaporizing the impacted armor materials. It is preferable to deflect the jet stream or fragments rather than attempting to stop it. Current ceramic armor systems that are most effective utilize sloped plates to accomplish this. Ceramics can withstand the high energy loads, but they are heavy and brittle.

Figure 1:
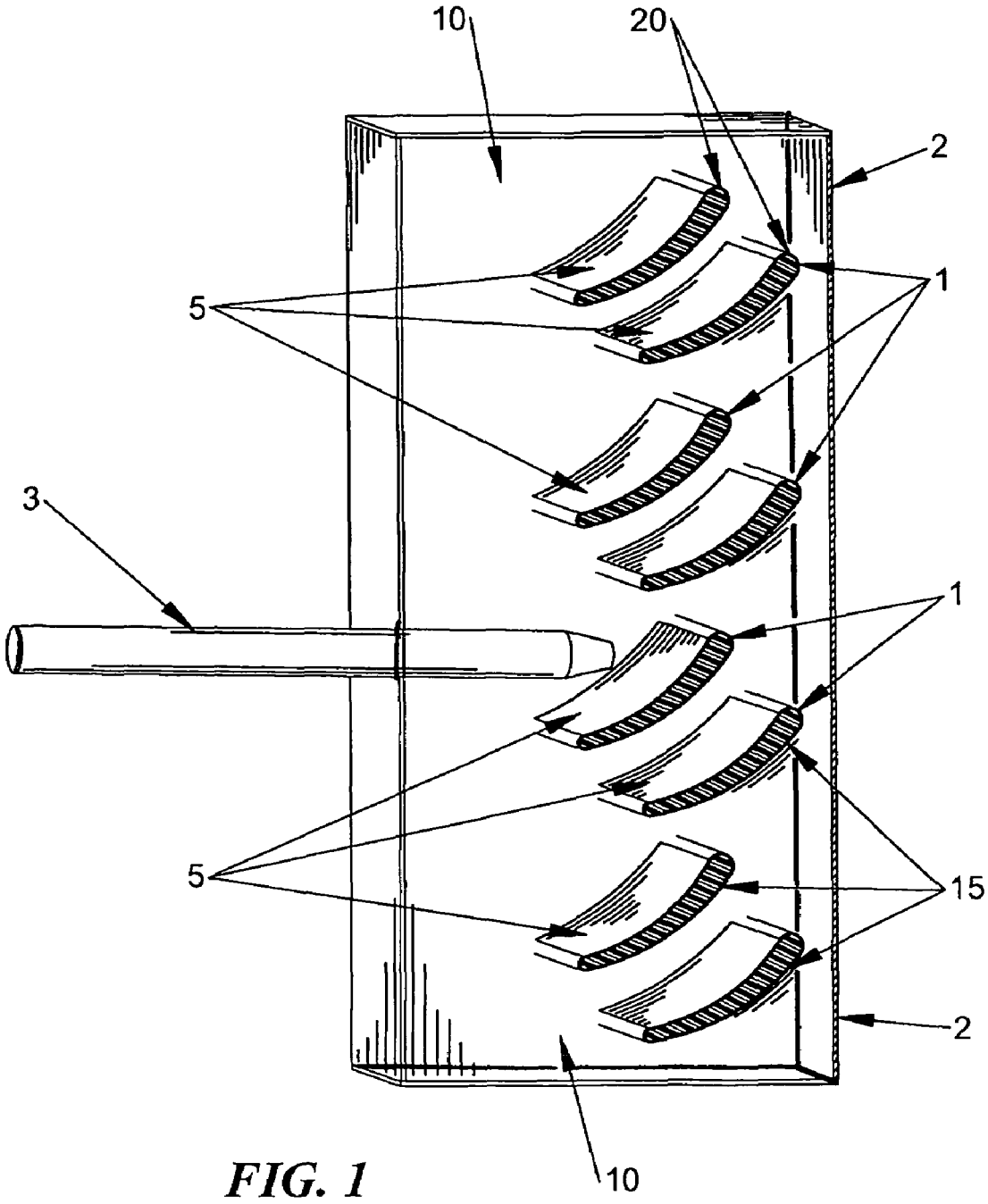
FIG. 1 shows a schematic side view of the armor showing the layers of the composite armor.

The invention utilizes a complementary mixture of materials to provide greater thermal capacity and friction resistance to thin metallic outer sheets used to construct lightweight deflecting armor components. Referring to FIG. 1, the invention consists of multiple layers of aluminum foil 1 separated by and embedded in composite bubble foam 10. The invention is designed to breakup the jet stream as it penetrates along path 3 into the armor interior. The aluminum foil layer's 1 front is coated with small water capsules to both cool and assist in deflecting the incoming round. The encapsulation of sufficiently large numbers of these small water capsules permits conversion to steam in a microsecond reaction time. A capsule of water 0.020" deep and 0.015" wide vaporizes into a high pressure column 0.3" tall exerting 900 pounds per square inch of pressure and expanding into a volume 50 times more at atmospheric pressure. This expansion cools a HEAT warhead's metal jet acts to exert deflecting side forces on the jet or fragments, which disrupting the jet and deflect fragments. This reactive mechanism from the vaporization of the water into steam works in conjunction with other armor components to provide a lightweight, effective armor system.

The very thin aluminum foil (0.030") 1 is indented on the front with numerous small conical pockets (without penetrating through to the opposite side) after being electrostatically dusted with zirconium nanoparticles. Water is forced into the numerous indentations on the front of the foil 1 and then sealed with another thinner layer of foil on the front 5. The water pockets cover the front surface of the foil 1 and instantly convert to steam upon contact from the generated high temperatures of either kinetic energy shrapnel or rounds penetrating into the armor or a shaped-charge jet penetrating into the armor. These minute steam explosions serve to push the incoming round away as the steam is superheated to near the temperature of the boundary layer of the jet stream in much the same fashion as explosive reactive armor. Because the armor system should be designed to most commonly engage rounds or shrapnel at an oblique angle, it is obvious from physics that much lower forces are needed to deflect than to stop a high speed projectile. The zirconium particles provide very high abrasion resistance in the composite armor as the projectile slides along the surface.

In the preferred embodiment, the aluminum foil's 1 back 15 is composed of a coating of a mixture of heat absorbing chemical compounds, such as potassium bicarbonate powder (Purple K), and coated microspheres and carbon fibers to provide support and absorb additional heat from the front surface of the film. The carbon fibers can be rolled into the aluminum foil 1 while it is hot along with the zirconium for better bonding. For maximum heat transfer to both water and heat absorbing compounds, multiple foil layers 1 are utilized and bonded onto metal mesh surfaces to form blocks of composite armor made up of a support matrix of composite bubble foam with imbedded, overlapping layers of the coated aluminum foil 1.

Figure 1A:
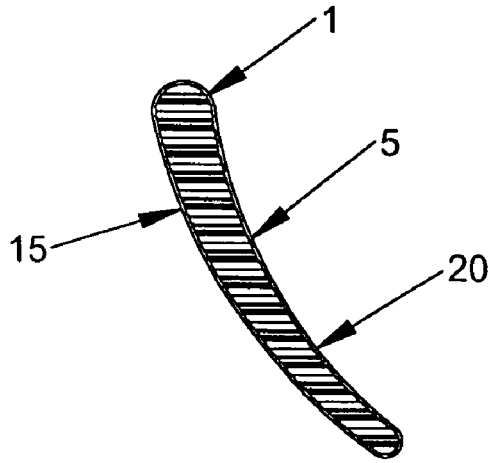
FIG. 1A is a cross section of the honeycombed vane components.

This armor protection is further enhanced by deforming and folding the coated aluminum foil into a honeycomb shaped configuration to form a concave curving tapered fin or vane 20. As shows in FIG. 1A, the tapered vane 20 includes the inner folded foil 1 arranged in a honeycomb. The outer layer of foil 5 seals the inner folder honeycomb to form the vanes 10. The back 15 is coated with a mixture of heat absorbing chemical compounds, such as potassium bicarbonate powder (Purple K), and coated microspheres and carbon fibers to provide support and absorb additional heat from the front surface of the film. The armor protection is further enhanced by angling the orientation of the layers relative to the horizontal and the path of a jet stream or projectile 3.

Figure 2:
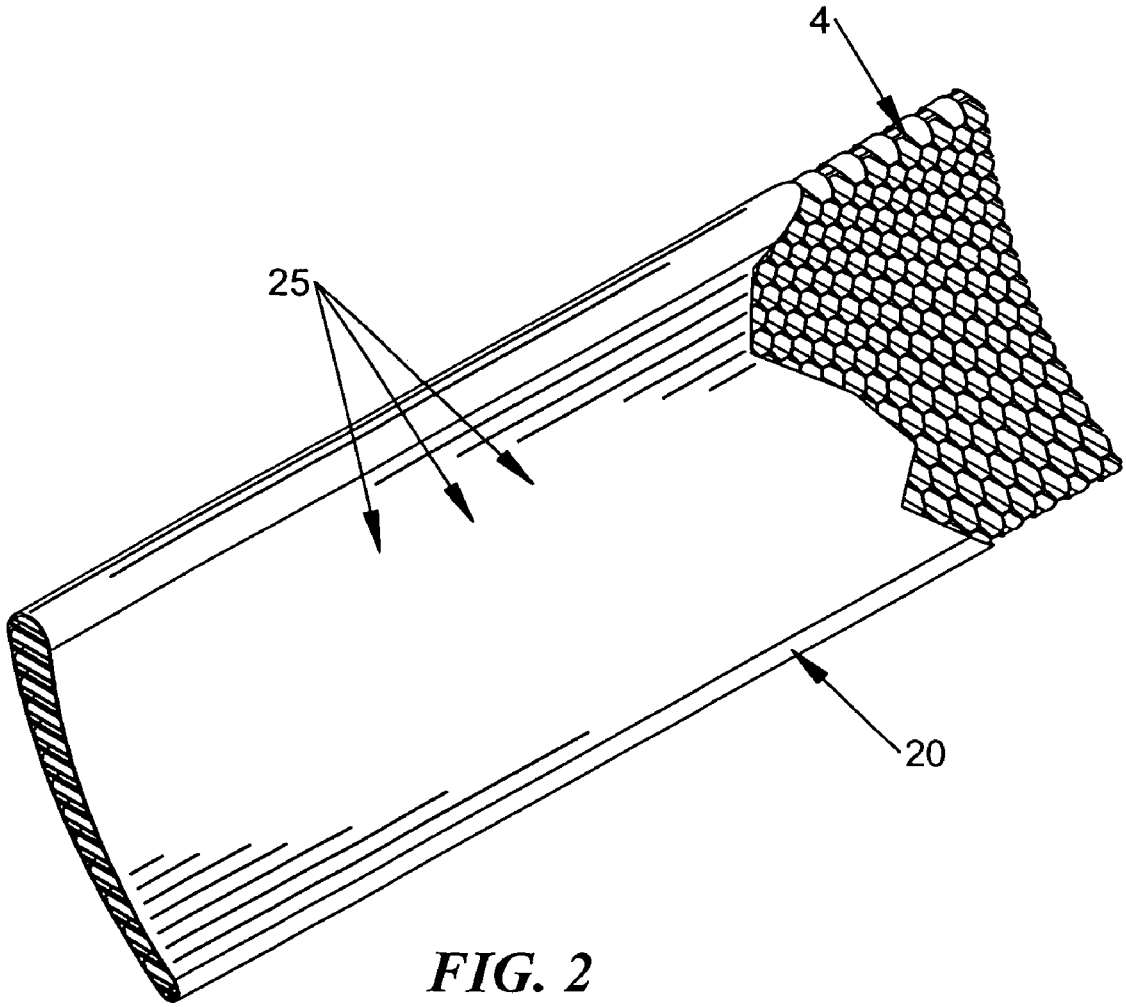
FIG. 2 is a larger view of the front side of the vane component.

FIG. 2 shows an enhanced view of the front side of the vanes 20 without the covering layer of foil 5. The front of the vanes 20 are covered with numerous indentions 25. These indentions deform into conical depressions approximately 0.020" deep and 0.015" wide that are filled with water. The surrounding surface is coated with zirconium dust or nanoparticles. The outer portion of the foil layers 1 are folded and arranged to form a relatively smooth outer surface, but internally the foil 1 forms overlapping honeycombed layers of material 4 with identical construction of water indentions 25 filled with water and the surrounding surface coated with zirconium facing outward. Conversely, the foil 1 layers on the reverse side are formed from the back layer 15 coated with a mixture of heat absorbing chemical compounds, coated microspheres, and carbon fibers. The vanes 20 are also formed with a concave curve to help further dissipate the kinetic and heat energy loads impacting the armor.

Figure 3:
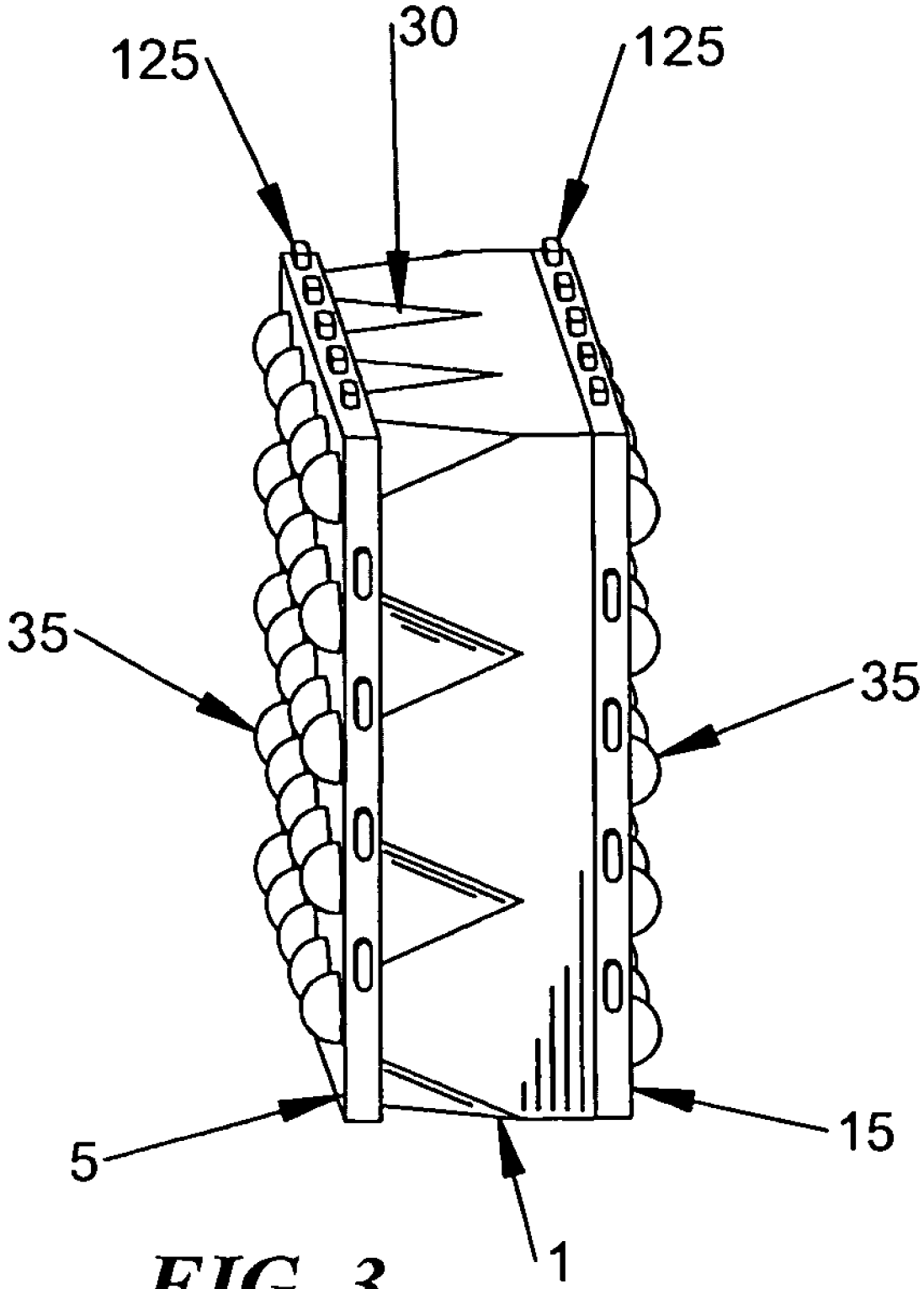
FIG. 3 is a cross section view of the foil used to build up the honeycombed vane components.

FIG. 3 shows a detailed side view of the foil 1. The foil layer 1 included conical depressions 30 in the surface of the foil 1. These conical depressions are approximately 0.020" deep and 0.015" wide that are filled with a water/anti-freeze mixture. They may also include very fine particles of Purple K. A coating of Purple K and zirconium particles cover the surface of the foil 1. An outer layer of thin film 5 is applied over the foil 1 to seal the water-filled indentions 30. Preferably, this thin film is a layer of aluminum, but it may be made of plastic or some other material. This layer of film 5 may also be coated with a layer of coated microspheres 35 and may include reinforcing carbon fibers 25. The back of the foil layer 1 also includes another thin film layer 15 with reinforcing carbon fibers 125. This back layer 15 is coated with microspheres 35 and also include a heat absorbing compound such as bicarbonate powder. The back layer 15 is preferably composed of a sticky plastic, or it may be made of another material such as aluminum. These multiple layers of foil 1 and carbon fibers 125 are folded to form the honeycombed vanes 20.

It is likely that multiple layers of this system would be used for protection against higher energy weapons. Unlike ceramics which reflect energy until their breaking point is reached, this system absorbs more of the energy protecting bystanders and occupants of vehicle. It is envisioned that this armor scheme can be used in conjunction with plastic bubble material coated with fire retardant material and charged with inert gases and water to provide spacing between metallic layers in other composite armor designs and to assist in slowing the projectile and eliminate the dangers of using ceramics.

Additionally, it is desirable to construct the outside surface of this armor system in a honeycomb-like fashion to catch some of the warheads before they go off and bounce them away before they detonate. Multiple layers of this armor are arranged so that a light weight honeycomb of armor is mounted to the vehicle. It also obvious that the energy and heat absorbing nature of this armor system would protect against mines and bombs without higher risk of reflected collateral damage.

While the invention has been particularly shown and described with respect to preferred embodiments, it will be readily understood that minor changes in the details of the invention may be made without departing from the spirit of the invention. Having described the invention,

I claim:

1. An apparatus for protecting against an explosive warhead, comprising:

an arrangement of multiple structural layers that includes a thin metal sheet imprinted on a first side with a network of adjoining hollow pockets, said sheet coated with a layer of metallic nanopowder and said pockets filled with water and anti-freeze and sealed;

a coat of potassium bicarbonate powder on a second side opposite the first side of the thin metal sheet; and a composite foam material used to form a matrix with multiple overlapping layers of said thin metal sheet imbedded so that the second side faces toward the surface of a building or vehicle and the first side faces away from the surface of a building or vehicle and arranged so that said layers of metal sheets overlap at an angle relative to the surface of the building or vehicle, said formed matrix referred to as a first foam block.

2. The apparatus for protecting against an explosive warhead of claim 1 wherein the metallic nanopowder comprises zirconium.

3. The apparatus for protecting against an explosive warhead of claim 1 wherein the metal sheet comprises aluminum.

4. The apparatus for protecting against an explosive warhead of claim 1 wherein the metal sheet is reinforced with a layer of carbon fibers.

5. The apparatus for protecting against an explosive warhead of claim 4 wherein the carbon fibers are a woven mesh.

6. The apparatus for protecting against an explosive warhead of claim 1 wherein the structural layer in contact with the building or vehicle is a panel of composite material to which the first foam block is attached.

7. The apparatus for protecting against an explosive warhead of claim 1 wherein a structural layer of composite foam charged with an inert gas is positioned between the first foam block and a vehicle or building surface.

8. The apparatus for protecting against an explosive warhead of claim 7 wherein the composite foam includes potassium bicarbonate.

9. The apparatus for protecting against an explosive warhead of claim 7 wherein the composite foam includes imbedded capsules filled with water.

10. The apparatus for protecting against an explosive warhead of claim 1 wherein a structural layer proximate to the second side of the metal foil includes a sticky plastic microspheres, potassium bicarbonate, and structural fibers.

11. The apparatus for protecting against an explosive warhead of claim 10 wherein the structural fibers are carbon fibers.

* * * * *